US005829755A

United States Patent [19]

Chen

[11] Patent Number: 5,829,755

[45] Date of Patent: Nov. 3, 1998

[54] DART TARGET WITH CLOCK AND ALARM FUNCTIONS

[76] Inventor: Wen-Kai Chen, 16th Fl.-4, No. 773, Tatun Rd., Kou Chien Li, Nan Tun Dist., Taichung, Taiwan

[21] Appl. No.: 882,084

[22] Filed: Jun. 25, 1997

[51] Int. Cl.[6] ..... F41J 3/02

[52] U.S. Cl. ..... 273/408; 273/371; 368/3

[58] Field of Search ..... 273/403, 404, 273/408, 409, 371, 376; 368/3

[56] References Cited

U.S. PATENT DOCUMENTS 5,401,033 3/1995 Lychock, Jr. ..... 273/371
5,648,752 7/1997 Alfrey ..... 273/376 X

FOREIGN PATENT DOCUMENTS 2091005 7/1982 United Kingdom ..... 368/3

*Primary Examiner*—William H. Grieb
*Attorney, Agent, or Firm*—Foley & Lardner

[57] ABSTRACT

A dart target with clock and alarm functions comprises a key assembly having a plurality of press buttons for setting time and alarm, at least one display for displaying score and state of the dart target in a game mode and displaying present time in a time mode, a target sensing region composed of a plurality of target areas for indicating different countries and regions, and a microcomputer having a time/alarm/clocking logic circuit for transmitting present time data in the time mode. With this arrangement, the display can automatically display present time when departing from the game mode.

6 Claims, 4 Drawing Sheets

DART TARGET WITH CLOCK AND ALARM FUNCTIONS

BACKGROUND OF THE INVENTION

1. Field of the Invention

The present invention is to provide a dart target, and more particularly to a dart target with clock and alarm functions.

2. Description of Related Art

A conventional dart target generally is hung on a wall and played in a manner of setting scores according to the hit position of a dart on the target. The target can only be utilized for recreational purposes, therefore, it is necessary to develop a dart target with more functions to meet the needs of people.

The present invention provides a dart target with clock and alarm functions which can be used as a wall clock to mitigate and/or obviate the aforementioned problems.

SUMMARY OF THE INVENTION

One object of the present invention is to provide a dart target with clock and alarm functions which has a display indicating present time when departing from a game mode.

In accordance with one aspect of the present invention, a dart target with clock and alarm functions comprises a key assembly having a plurality of press buttons for setting time and alarm, at least one display for displaying the score and state of the dart target in a game mode and displaying present time in a time mode, a target sensing region composed of a plurality of target areas for indicating different countries and regions, and a micro-computer having a time/alarm/clocking logic circuit for transmitting present time data in the time mode.

In accordance with another aspect of the present invention, the press buttons of the key assembly are configured to share with a plurality of function keys of the dart target so that the press buttons are able to adjust time and alarm in the time mode.

In accordance with a further aspect of the present invention, the target sensing region further has a plurality of numeral buttons for selecting different countries and regions.

In accordance with still a further aspect of the present invention, the micro-computer further includes a read-only memory provided for storing a conversion chart of different countries and regions and (or) storing music or sound representing different regions.

Other objects, advantages and novel features of the invention will become more apparent from the following detailed description when taken in conjunction with the accompanying drawings.

DETAILED DESCRIPTION OF PREFERRED EMBODIMENT

Figure 1:
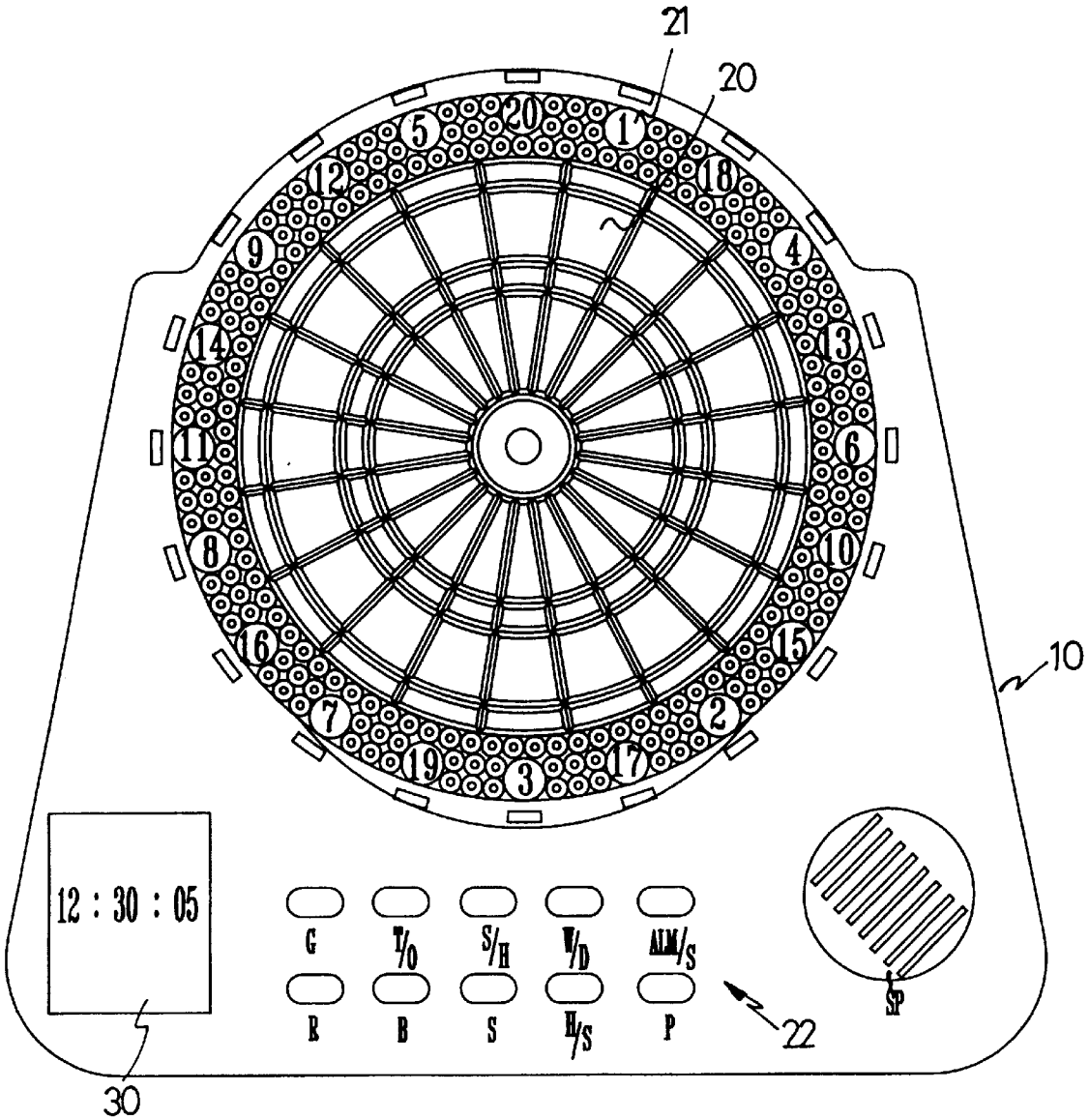
FIG. 1 is a plane view showing a dart target with clock and alarm functions in accordance with a preferred embodiment of the present invention.

Referring to FIG. 1, the dart target with clock and alarm functions 10 in accordance with the present invention has a basic configuration similar to a conventional dart target, which comprises a display 30 for displaying the score, a key assembly 22 having a plurality of press buttons for selecting various game modes, a loudspeaker SP and a target sensing region 20 composed of a plurality of target areas with different sizes and shapes. However, the present invention further provides a dart target 10 in which the display 30 can automatically indicate present time in addition to the game modes. For this purpose, in addition to a game key G, a reset key R, a bounce out key B, a solitaire key S, a hole/start key HS, and a player key P provided on a conventional dart target 10, the key assembly 22 of the dart target of this invention is configured to have a time/option key T/O for selecting a game mode or a time mode, a set/handicap key S/H for setting the clock and alarm or for setting the degree of difficulty of the game, a world/double key W/D for selecting a country having the present time or scores, as well as an alarm/sound key ALM/S for selecting an alarm or a music sound. Before the game key G is pressed, the key assembly 22 is assumed to be in the time mode, that is the T/O key is selected to a time mode, the S/H is selected to set clock and alarm, the W/D key is selected to a country having present time. At the same time, the display 30 displays the present time.

As mentioned above, the target sensing region 20 of the dart target is composed of a plurality of target areas. At a periphery of the target areas, several buttons 21 indicated by different numerals are defined. Each of these buttons 21 may be printed with different country or city names (not shown), for indicating the present time in different countries and cities. When the present time of one country is desired to be displayed on the display 30, it is achieved by the user directly pressing the corresponding numeral button 21. In this way, the dart target 10 can provide a clock displaying time for many different countries.

Figure 2:
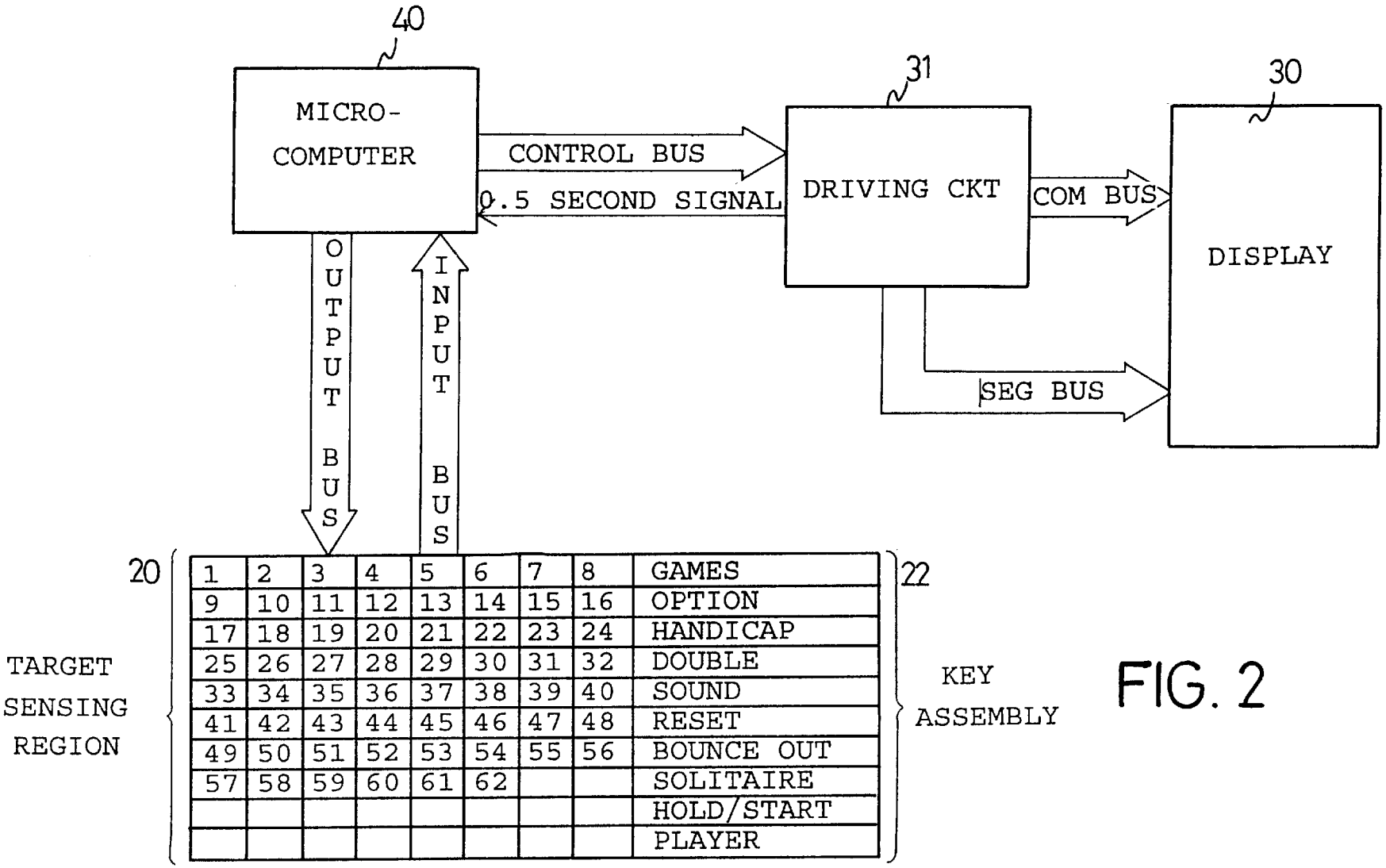
FIG. 2 is a block view showing the circuitry of the dart target with clock and alarm functions of FIG. 1.

FIG. 2 is a block view showing a circuitry of the dart target with clock and alarm functions of FIG. 1. Similar to the conventional dart target, the key assembly 22 is connected to an input of a micro-computer 40 and a matrix loop constructed by the target sensing region 20 is connected to an output of the micro-computer 40. The microcomputer 40 responds to the target sensing region 20 and the key assembly 22 and processes signals therefrom. Then the processed signals are sent to the display 30 via a display bus and a driving circuit 31 such that the display 30 can indicate game scores or present time.

Figure 3:
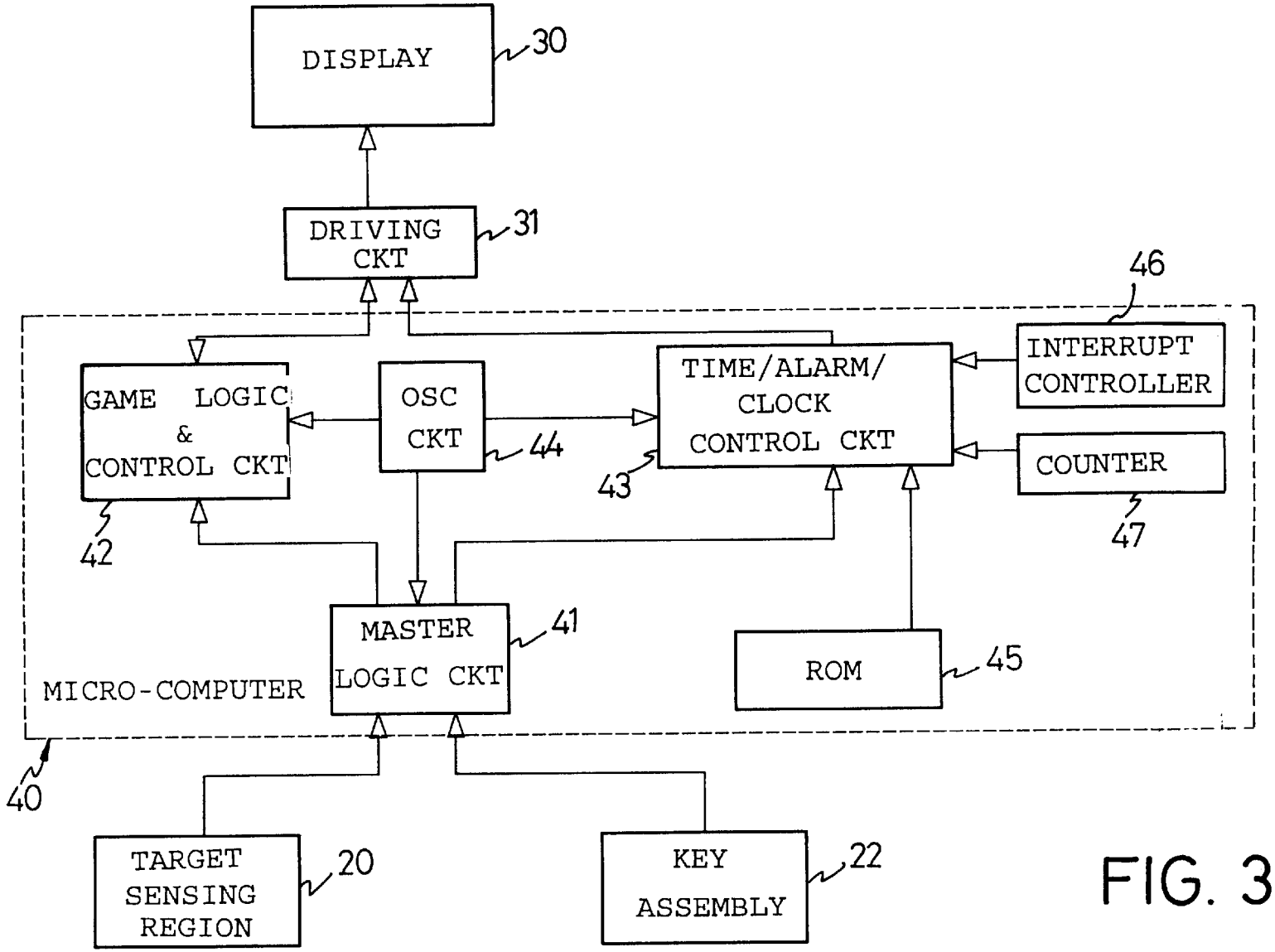
FIG. 3 is a block view showing a detailed circuit of the circuitry of FIG. 2.

FIG. 3 is a block view showing a detailed circuit of the circuitry of FIG. 2. It is understood that the difference of circuits between the conventional dart target and the present invention is that a control circuit for displaying time and alarm is added to the micro-computer 40 of the dart target of this invention. The micro-computer 40 comprises a master logic circuit 41 connected with the target sensing region 20 and the key assembly 22, a game logic and control circuit 42 set to operate under a game mode, a time/alarm/clocking logic and control circuit 43 set to operate under a time mode, an oscillating circuit 44 supplying required sequential signals, three interrupt controllers 46 relative to the time/alarm/clocking logic and control circuit 43, a counter 47 and a read-only memory 45. When the dart target is in a game mode, data input from the key assembly 22 is sent to the game logic and control circuit 42 via the master logic circuit 41 to calculate and process scores. Then the processed data is sent to the display 30 via the driving circuit 31, and thus the display 30 displays the score and game mode. At the same time, the time/alarm/clocking logic and control circuit 43 continues clocking in accordance with the sequential signals input by the oscillating circuit 44. When the dart target is selected to the time mode, the time/alarm/clocking logic and control circuit 43 will transmit data of the present time to the driving circuit 31 and display the present time on the display 30. Also, the read-only memory 45 is provided for storing a time conversion chart for different countries and regions and (or) storing music or sound representing different regions. When one numeral button 21 of FIG. 1 is pressed, the micro-computer 40 will detect signals therefrom and access the read-only memory 45 to obtain the present time of the corresponding country. Then the display 30 will display the time and the loudspeaker SP will transmit the corresponding music and sound.

Figure 4:
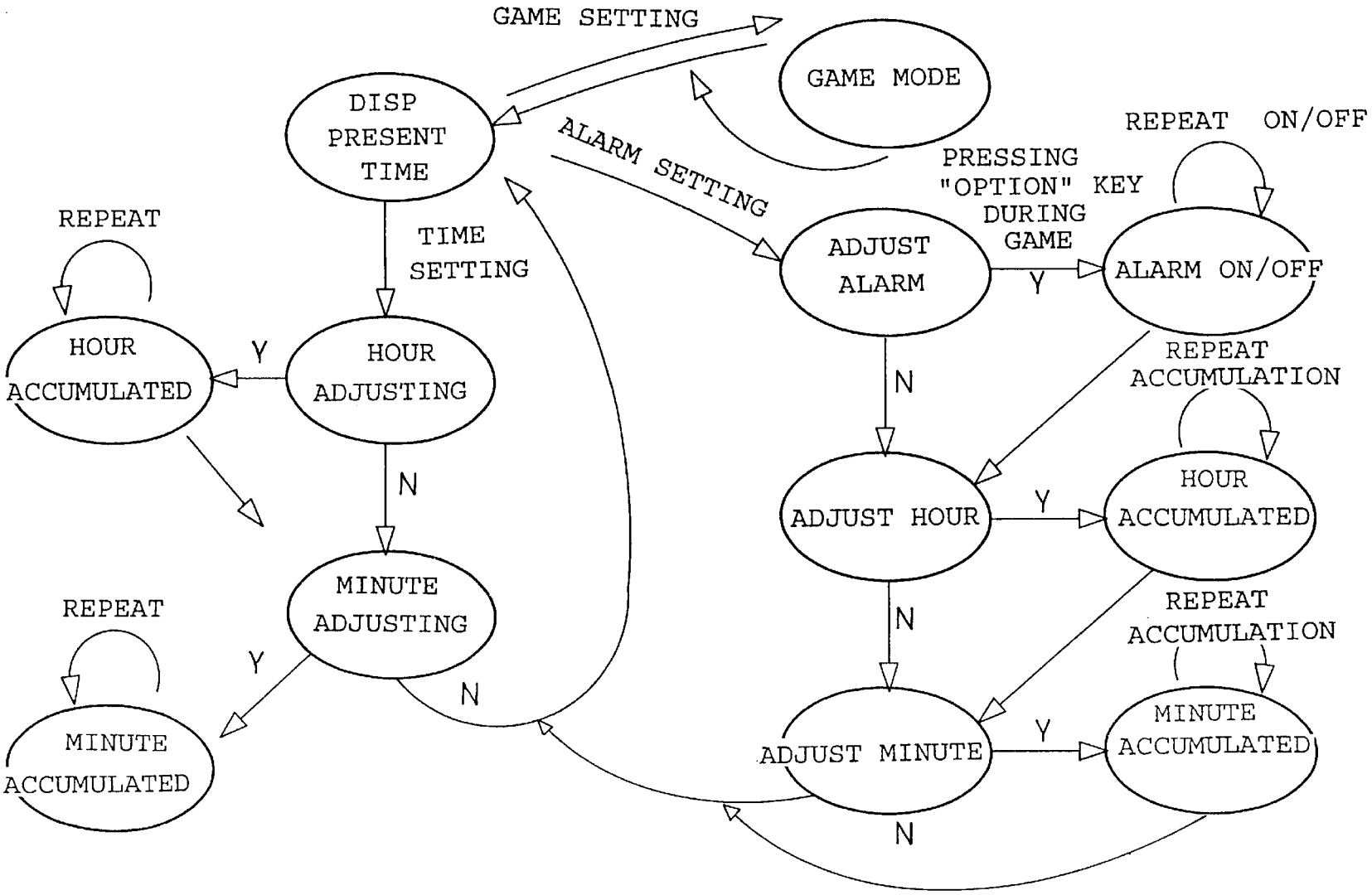
FIG. 4 is a flow-process diagram showing the operation of the dart target with clock and alarm functions of FIG. 1.

FIG. 4 is a flow-process diagram showing the operation of the dart target with clock and alarm functions of FIG. 1. When the dart target departs from the game mode or has been idle for a period, the display 30 will automatically display present time. When the dart target is selected to set time and alarm, the setting method is the same as that of a digital electric clock.

The above mentioned description concerns one of the embodiments of the present invention. In practice, more than one display 30 can be utilized and substituted with liquid-crystal displays, seven-segment-displaying light emitting diodes or cathode-ray tubes, which do not divert from the scope and spirit of the present invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A dart target with clock and alarm functions comprising:

a key assembly having a plurality of press buttons for setting time and alarm;

at least one display for displaying score and state of the dart target in a game mode and displaying present time in a time mode;

a micro-computer having a time/alarm/clocking logic circuit for transmitting present time data in the time mode; and a target sensing region composed of a plurality of target areas for selecting the present time to be displayed for different countries and regions in the time mode.

2. A dart target with clock and alarm functions as claimed in claim 1, wherein said press buttons of the key assembly are configured to share with a plurality of function keys of the dart target so that the press buttons are able to adjust time and alarm in the time mode.

3. A dart target with clock and alarm functions as claimed in claim 1, wherein said target sensing region further has a plurality of numeral buttons for selecting different countries and regions.

4. A dart target with clock and alarm functions as claimed in claim 1, wherein said micro-computer further includes a read-only memory provided for storing a time conversion chart of different countries and regions and (or) storing music or sound representing different regions.

5. A dart target with clock and alarm functions as claimed in claim 1, wherein said display can be substituted with liquid-crystal displays, seven-segment-displaying light emitting diodes or cathode-ray tubes.

6. A dart target with clock and alarm functions as claimed in claim 1, wherein said time/alarm/clocking logic circuit of the micro-computer is connected with an oscillating circuit inside the micro-computer to directly receive clocking signals.

* * * * *